US010791799B2

(12) United States Patent
Regan et al.

(10) Patent No.: US 10,791,799 B2
(45) Date of Patent: Oct. 6, 2020

(54) ENERGY EFFICIENT INFRARED OVEN WITH AIR CIRCULATION

(71) Applicant: NIKE, Inc., Beaverton, OR (US)

(72) Inventors: Patrick Regan, Singapore (SG); Shih-Yuan Wu, Taichung (CN); Geoffrey Nichols, Ho Chi Minh (VN); Yu-Shu Hsiao, Douliu (TW); Min Chuan Chang, Changhua (TW); Chang Min-Li, Changhua (TW)

(73) Assignee: NIKE, INC., Beaverton, OR (US)

( * ) Notice: Subject to any disclaimer, the term of this patent is extended or adjusted under 35 U.S.C. 154(b) by 531 days.

(21) Appl. No.: 15/627,002

(22) Filed: Jun. 19, 2017

(65) Prior Publication Data

US 2017/0360157 A1 Dec. 21, 2017

Related U.S. Application Data

(60) Provisional application No. 62/351,703, filed on Jun. 17, 2016.

(51) Int. Cl.
*A43D 95/10* (2006.01)
*H05B 3/00* (2006.01)
(Continued)

(52) U.S. Cl.
CPC ..... *A43D 95/10* (2013.01); *A43D 25/20* (2013.01); *A43D 111/00* (2013.01);
(Continued)

(58) Field of Classification Search
None
See application file for complete search history.

(56) References Cited

U.S. PATENT DOCUMENTS 3,755,916 A * 9/1973 Gulaian ..... F26B 21/004 34/105
4,127,945 A * 12/1978 Nothen ..... B29B 13/06 34/216
(Continued)

FOREIGN PATENT DOCUMENTS

CN 2301881 Y 12/1998
CN 2891742 Y 4/2007
(Continued)

OTHER PUBLICATIONS

International Search Report and Written Opinion dated Nov. 30, 2017 in International Patent Application No. PCT/US2017/038163, 18 pages.
(Continued)

*Primary Examiner* — Thor S Campbell
(74) *Attorney, Agent, or Firm* — Shook, Hardy & Bacon L.L.P.

(57) ABSTRACT

An oven may facilitate heating, curing, and/or drying processes for manufactured items, such as shoe parts, using multiple groups of infrared sources. Efficiencies of the oven are achieved through a deliberate airflow characteristic, which is accomplished with a configuration of apertures extending through a circulation plate. A higher concentration of apertures is formed in the circulation plate near a center zone relative to zones near an entrance and exit to the oven. Further, the shape of the apertures in the circulation plate aid in improved airflow within the oven.

18 Claims, 5 Drawing Sheets

(51) Int. Cl.

| | |
|---|---|
| ***F26B 3/30*** | (2006.01) |
| ***F26B 15/18*** | (2006.01) |
| ***F26B 21/12*** | (2006.01) |
| ***A43D 111/00*** | (2006.01) |
| ***A43D 25/20*** | (2006.01) |
| ***F26B 21/04*** | (2006.01) |
| ***F26B 21/10*** | (2006.01) |
| ***A43D 117/00*** | (2006.01) |
| ***F26B 21/08*** | (2006.01) |

(52) U.S. Cl.
CPC ..... *A43D 117/00* (2013.01); *F26B 3/30* (2013.01); *F26B 15/18* (2013.01); *F26B 21/04* (2013.01); *F26B 21/08* (2013.01); *F26B 21/10* (2013.01); *F26B 21/12* (2013.01); *H05B 3/0038* (2013.01)

(56) References Cited

U.S. PATENT DOCUMENTS 4,494,316 A * 1/1985 Stephansen ..... F26B 3/283 219/388
4,662,085 A * 5/1987 Russo ..... F26B 15/128 34/105
4,756,091 A * 7/1988 Van Denend ..... A43D 25/20 219/388
4,909,430 A * 3/1990 Yokota ..... B23K 1/008 219/388
5,066,850 A * 11/1991 Kondo ..... B23K 1/008 219/388
5,154,338 A * 10/1992 Okuno ..... B23K 1/008 219/388
5,180,096 A * 1/1993 Kondo ..... B23K 1/008 228/180.1
5,272,970 A * 12/1993 Burke ..... F26B 15/128 101/37
5,345,061 A * 9/1994 Chanasyk ..... B23K 1/008 219/388
5,440,101 A * 8/1995 Cox ..... B23K 1/008 219/388
5,737,851 A * 4/1998 Novak ..... F26B 3/283 34/420
5,848,889 A * 12/1998 Tietz ..... H01L 21/68735 432/258
5,937,535 A * 8/1999 Hoffman, Jr. ..... F26B 13/101 118/65
6,026,748 A * 2/2000 Reed ..... F26B 3/283 101/424.1
6,146,678 A * 11/2000 Caridis ..... A21B 1/245 426/510
6,289,604 B1 9/2001 Chang
6,572,911 B1 * 6/2003 Corcoran ..... A21B 1/245 426/510
6,833,533 B1 * 12/2004 Wolfe ..... A21B 1/245 219/388
7,692,119 B2 * 4/2010 Shibamura ..... B23K 1/008 219/388
7,836,874 B2 * 11/2010 McFadden ..... A21B 1/245 126/21 A
10,082,346 B2 * 9/2018 Elser ..... H01L 21/67098
2002/0146657 A1 * 10/2002 Anderson ..... B23K 1/008 432/11
2004/0109986 A1 * 6/2004 Keese ..... A47J 36/02 428/167
2007/0137633 A1 * 6/2007 McFadden ..... A21B 1/245 126/21 A
2010/0012705 A1 * 1/2010 Nakamura ..... B23K 1/0016 228/19
2010/0270293 A1 * 10/2010 McNamee ..... A21B 1/245 219/725
2011/0126818 A1 * 6/2011 Behle ..... A21B 1/245 126/21 A
2012/0060388 A1 * 3/2012 Rocheleau ..... F26B 13/101 34/659
2016/0111586 A1 * 4/2016 Rey-Garcia ..... H01L 21/67173 438/61

FOREIGN PATENT DOCUMENTS

| | | | |
|---|---|---|---|
| CN | 201178738 | Y | 1/2009 |
| CN | 201752258 | U | 3/2011 |
| CN | 203810909 | U | 9/2014 |
| CN | 203986408 | U | 12/2014 |
| CN | 204336007 | U | 5/2015 |
| CN | 204426896 | U | 7/2015 |
| CN | 205233639 | U | 5/2016 |
| TW | I254617 | B | 5/2006 |
| WO | 2017219031 | A1 | 12/2017 |

OTHER PUBLICATIONS

International Preliminary Report on Patentability mailed Dec. 27, 2018 in International Patent Application No. PCT/US2017/038163, 18 pages.

* cited by examiner

ENERGY EFFICIENT INFRARED OVEN WITH AIR CIRCULATION

CROSS-REFERENCE TO RELATED APPLICATIONS

This application having attorney docket number NIKE.276302/150187US02 and entitled "Energy Efficient Infrared Oven With Air Circulation" claims the benefit of U.S. Provisional Application No. 62/351,703, entitled " Energy Efficient Infrared Oven With Air Circulation," and filed Jun. 17, 2016. The entirety of the aforementioned application is incorporated by reference herein.

FIELD

Aspects hereof relate to ovens for use in manufacturing processes, such as curing and/or drying shoe parts during a shoe assembly process.

SUMMARY

Aspects hereof may be useful for a variety of processes in the manufacturing of items such as shoes in addition to or instead of curing or otherwise handling adhesives. For example, ovens in accordance with aspects hereof may be used to dry paints or dyes, to dry shoes or shoe components after washing, to evaporate residual solvents or other substances, etc. While the term "curing" is often used herein to describe processes performed by ovens in accordance with aspects hereof, ovens in accordance with aspects hereof may be used for any type of curing, drying, and/or heating of items such as shoes and/or shoe parts.

Specifically, an oven may be comprised of one or more infrared energy emitting elements. The infrared elements may emit in the mid-infrared range, such as wavelengths in the 3-50 micrometer range. In addition to emitting infrared energy, airflow may be adjusted to increase the efficiency and/or throughput speed of the oven. Specifically, it is contemplated that air is recirculated within the oven such that airflow characteristics (e.g., flow pattern, velocity, angle, volume) may be adjusted based on measured variables (e.g., humidity, temperature), based on materials, and/or based on oven design. For example, an oven having a conveyance system allowing for continuous processing with an entry and exit, adjusting the airflow characteristics proximate the entry and/or exit may increase the operational efficiencies of the oven. In an example provided herein, a first region of the oven near an entrance to the oven and a third region of the oven near an exit of the oven may have different airflow characteristics than a second region positioned between the first and third regions. For example, spacing in a longitudinal direction (direction of material flow through the oven) of airflow vents in the first and third regions may be less than the second region. Stated differently, a higher concentration of apertures in a given measure (e.g., square meter) for venting air may be positioned in the second region than in the first and/or third regions. This reduced concentration may limit unintentional expulsion of air at the entry and/or exit, which may increase the efficiency of the oven by limiting the unintentional expulsion of the air. Additionally, it is contemplated that two or more oven lines may extend through a common oven. Each of the oven lines may be configured differently to accommodate the materials/components passing there through. For example, a first line may be used for footwear uppers and a second line may be used for footwear bottom units (e.g., soles) allowing for the co-curing/drying of the components for eventual combination. This layering concept may reduce operating space needed to cure the components and allow for a sharing of resources and/or an increase in efficiencies.

In an exemplary aspect, an energy efficient oven comprises a chamber that has an entry on a first side and an exit on an opposite second side with a top extending between the first side and the second side is provided. A longitudinal direction of the oven is defined as extending between the first side and the second side. This oven also includes a conveyance system that extends within the chamber from the first side to the second side. Further, the oven includes a circulation plate that extends between the conveyance system and the top of the chamber. The circulation plate is comprised of a first region proximate the chamber first side, a second region, and a third region proximate the chamber second side, the second region is between the first region and the third region. The circulation plate first region is comprised of a plurality of first region apertures; the circulation plate second region is comprised of a plurality of second region apertures; and the circulation plate third region comprised of a plurality of third region apertures. A first distance extending in the longitudinal direction between longitudinally adjacent apertures of the plurality of first region apertures, a second distance extending in the longitudinal direction between longitudinally adjacent apertures of the plurality of second region apertures, and a third distance extending in the longitudinal direction between longitudinally adjacent apertures of the plurality of third region apertures. The second distance is less than the first distance and third distance.

In an additional exemplary aspect, an energy efficient oven comprises a chamber, a conveyance system, an infrared source, and a circulation plate. The circulation plate extends between the conveyance system and a top of the chamber. The circulation plate is comprised of a first region proximate the chamber first side, a second region, and a third region proximate the chamber second side. The second region is between the first region and the third region. The first region is comprised of a plurality of first region apertures, the second region is comprised of a plurality of second region apertures, and the third region is comprised of a plurality of third region apertures. In this example there is a higher concentration of second region apertures than a concentration of first region apertures or a concentration of second region apertures for a similar measured area (e.g., a square meter). In an alternative example, the second region has a greater number of apertures positioned between longitudinally adjacent infrared sources than in the first or third regions.

This summary is provide to introduce concepts developed more fully hereinafter and should not be construed as limiting.

DRAWINGS

The drawings described herein are referred to using particular numbers in which:

FIG. 1 illustrates a schematic diagram of an example of an energy efficient oven in accordance with aspects hereof;

FIG. 2 further illustrates a side view of the energy efficient oven, in accordance with aspects hereof;

DETAILED DESCRIPTION

Figure 1:
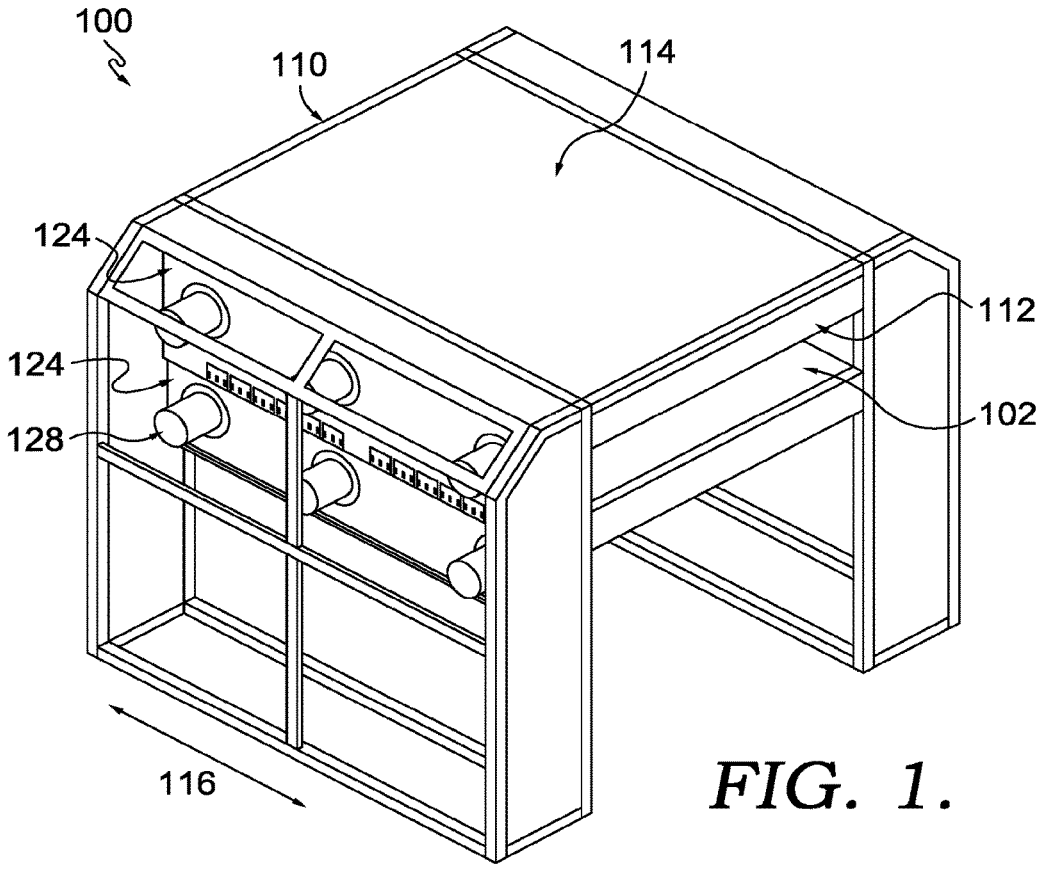

Aspects hereof relate to an energy efficient infrared oven for use in manufacturing processes. While examples of ovens in accordance with aspects hereof are described for application in a shoe manufacturing process, many other manufactured items may require or benefit from infrared heating. By way of example, the manufacturing of shoes, particularly athletic shoes, often involves assembling various components using adhesives to bond those components together, either permanently or until other joining mechanisms, such as stitching, may be employed. In order to obtain a strong adhesive bond suitable for extended use by an ultimate purchaser and/or wearer, particularly for athletic endeavors that place high demands upon the bond strength and bond durability, properly processing the adhesives used for shoe assembly allows for effective production. However, the use of such adhesives may require complicated and involved processes and the careful control of parameters such as the temperature, the ambient humidity, and other factors that impact the properties of materials being cured. For example, the physical performance and/or appearance of a material used in manufacturing a shoe or shoe part may depend upon the precise control of the ambient parameters used to cure that material. If the appropriate ambient parameters cannot be provided, alternative approaches to attaining a desired performance level or appearance may be employed, such as the use of additional amounts of primers or adhesives, even if the additional amounts of primers or adhesives used as a "failsafe" in such a circumstance are potentially wasteful or even environmentally harmful. Thus, use of ovens in accordance with aspects hereof may permit the manufacturing of a shoe of the same or higher quality than can be obtained through other processes that do not provide such precise control of ambient parameters during curing, while also providing, in some circumstances, reduced material cost and lessened environmental impact.

In addition to the quality of finished products and the efficient use of materials, ovens used in a manufacturing process also consume energy. Ovens in accordance with aspects hereof may utilize multiple groups or pluralities of common spectral range infrared sources. Accordingly, operations on an item may be efficiently performed without expending energy emitting large amounts of radiation at unnecessary wave lengths. Further, efficiencies may be achieved by a controlled air flow within the oven. For example, airflow may be effective to moderate temperature of a part passing through the oven, but the air flow may also cause thermal energy to be expelled from the oven entrance and/or exit. Therefore, airflow emission characteristics proximate the entrance and/or exit may diverge from airflow emission characteristics in a region between the entrance and exit. Stated differently, a balancing between the benefits of airflow within an oven and the potential loss of energy efficiency as thermal energy is forced out of the oven may be achieved by a varied airflow emission characteristic along a longitudinal length of the oven.

While challenges in curing adhesives may be particularly present in the production of shoes, similar challenges may be faced by any manufacturing process using adhesives. Moreover, energy efficient infrared ovens in accordance with aspects hereof may be used for processes other than curing adhesives. Heating manufactured items and/or components of manufactured items using energy efficient ovens may serve any purpose.

While ovens in accordance with aspects hereof are not limited to use in curing adhesives and primers used in applying adhesives, adhesives and primers for adhesives provide one particular example of the use of ovens and methods in accordance with aspects hereof. As explained above, the performance of compounds used in the adhesive process may be critical the ultimate creation of a high-quality shoe. The application of adhesives may be a multi-step process, with primers being applied to one or both parts to be joined, possibly in multiple layers. Different layers and/or different primers and different adhesives on different shoe parts may require independent curing or activation. Ovens and methods in accordance with aspects hereof may be used for some or all of the curing processes needed to manufacture a shoe or a portion of a shoe.

Curing processes, whether for primers or adhesives, often require heating a shoe part with the primer and/or adhesive applied to it to a precise temperature or range of temperatures and holding that part at that temperature for a predetermined amount of time. Sometimes, a particular primer or adhesive may benefit from a multi-stage heating process, with different temperatures being achieved and maintained in sequence. Further, other parameters such as the relative humidity in the ambient air around a shoe part, the flow of air around a shoe part, and other factors may impact the quality of an adhesive bond ultimately attained in shoe assembly. Adequately controlling the various parameters that may impact bond performance and shoe assembly has presented challenges in the shoe manufacturing process. One approach to the difficulties in managing adhesive curing parameters has been to perform rigorous quality control verification on fully or partially manufactured shoes to reject shoes or shoe components that, for whatever reason, failed to attain adequate bond strength. However, while rigorous quality control may be maintained, using ovens and methods in accordance with aspects hereof may result in fewer shoes failing quality control checks due to improved processes and process control during adhesive curing.

Aspects hereof may be useful for a variety of processes in the manufacturing of items such as shoes in addition to or instead of curing or otherwise handling adhesives. For example, ovens in accordance with aspects hereof may be used to dry paints or dyes, to dry shoes or shoe components after washing, to evaporate residual solvents or other substances, etc. While the term "curing" is often used herein to describe processes performed by ovens in accordance with aspects hereof, ovens in accordance with aspects hereof may be used for any type of curing, drying, and/or heating of items such as shoes and/or shoe parts.

Aspects hereof permits improved adhesive performance by permitting precise control of cure parameters for a shoe or shoe part. For example, the temperature, rate of temperature change, relative humidity, and/or air flow around a shoe or shoe part may be precisely controlled using ovens and methods in accordance with aspects hereof. Ovens in accordance with aspects hereof may utilize a mid-band infrared source. For example, a mid-infrared ("MIR") may have a wavelength of 3-50 micrometers (i.e., 3,000 nm-50,000 nm) wavelength as defined in the ISO 20473 scheme, for example. Further, in an exemplary aspect, the infrared source emits energy in a wavelength between 2 and 6 micrometers. In yet a further example, one or more of the infrared sources emit energy in a wavelength between 3 and 5 micrometers. However, as provided herein, it is contemplated that the range of MIR may adjust greater or lower based on components to be exposed to the infrared energy. Different pluralities of infrared sources and/or different zones of an oven may operate with different heating parameters. Heating parameters may comprise, but are not limited to, an output power, a distance between one or more infrared sources and an item to be heated, a density of infrared sources within an area of an oven, a shape of infrared sources, an arrangement of infrared sources relative to an item to be heated, and air flow rate around an item to be heated, a density of airflow ports in different zones, a directional characteristic of airflow in different zones, a size of airflow emitters/nozzles in a given zone, a relative humidity of air around an item to be heated, etc.

Different zones and/or different pluralities of infrared sources may share all, some or no heating parameters. For example, different pluralities of infrared sources may be spaced at different distances from an item such as a shoe or shoe part to be cured and at a different density, i.e., with greater numbers of sources per linear distance through the oven. Yet a further variation is possible by selecting or controlling the power output of individual infrared sources of a plurality. A first plurality of MIR sources may be operated at a first wattage, while a second plurality of MIR sources may be operated at a second wattage. Similarly, the first plurality of MIR sources may be positioned at a first distance from an item to be cured with a first linear distance between individual sources of the plurality of infrared sources of the mid infrared plurality, while the second plurality of MIR sources may be positioned at a second distance from an item to be cured with a second linear spacing.

The peak wavelength of one or more infrared source used in an oven in accordance with aspects hereof may be selected based upon the stage of a curing and/or drying process to be performed using a given source. Different stages of curing and/or drying may involve different components of the item to be cured and/or dried. For example, one or more mid-infrared sources may be used at an early stage of an oven in order to quickly dry a part, as water molecules readily absorb mid infrared radiation, thereby evaporating the water molecules. Other types of materials, such as polyethylene and PVC, may preferentially absorb mid infrared radiation, thereby enabling such materials to be rapidly heated using mid infrared sources. Other types of materials may preferentially absorb other wavelengths, and infrared sources strongly emitting at those wavelengths may be selected to heat such materials. Based upon the heating to be performed, energy restrictions, time limitations, materials used, etc., different types of sources in different arrangements and numbers/densities may be used at various stages of an oven in accordance with aspects hereof.

Sensors within the oven may dynamically measure temperature, humidity, airflow, or other properties within the oven or within a particular zone of the oven, thereby permitting an operably connected logical unit to adjust the operation of the oven to attain or maintain desired operating conditions within the oven. For example, the wattage of a plurality of infrared sources or an individual infrared source within a plurality of infrared sources may be adjusted in response to a measured temperature. Based upon sensor reading and target ambient parameters, a logical unit may adjust air flow using fans, activate or deactivates condenser units to impact relative humidity, etc. By way of further example, shoe parts or entire shoes to be cured may be conveyed through the oven on a conveyor belt or other conveyance mechanism, and the rate of travel of the belt may be adjusted in accordance with sensor readings to obtain optimal curing and/or drying conditions for the parts to be cured and/or dried.

While ovens and methods in accordance with the aspects hereof are described herein for examples that cure primers and/or adhesives, ovens and methods in accordance with aspects hereof may be used to cure paints, dyes, materials, etc.

Aspects hereof may be useful for a variety of processes in the manufacturing of items such as shoes in addition to or instead of curing or otherwise handling adhesives. For example, ovens in accordance with aspects hereof may be used to dry paints or dyes, to dry shoes or shoe components after washing, to evaporate residual solvents or other substances, etc. While the term "curing" is often used herein to describe processes performed by ovens in accordance with aspects hereof, ovens in accordance with aspects hereof may be used for any type of curing, drying, and/or heating of items such as shoes and/or shoe parts.

Specifically, an oven may be comprised of one or more infrared energy emitting elements. The infrared elements may emit in the MIR range, such as wavelengths in the 3-50 micrometer range. In addition to emitting infrared energy, airflow may be adjusted to increase the efficiency and/or throughput speed of the oven. Specifically, it is contemplated that air is recirculated within the oven such that airflow characteristics (e.g., flow pattern, velocity, angle, volume) may be adjusted based on measured variables (e.g., humidity, temperature), based on materials, and/or based on oven design. For example, an oven having a conveyance system allowing for continuous processing with an entry and exit, adjusting the airflow characteristics proximate the entry and/or exit may increase the operational efficiencies of the oven. In an example provided herein, a first region of the oven near an entrance to the oven and a third region of the oven near an exit of the oven may have different airflow characteristics than a second region positioned between the first and third regions. For example, spacing in a longitudinal direction (direction of material flow through the oven) of airflow vents (i.e. apertures) in the first and third regions may be less than the second region. Stated differently, a higher concentration of apertures in a given measure (e.g., square meter) for venting air may be positioned in the second region than in the first and/or third regions. This reduced concentration may limit unintentional expulsion of air at the entry and/or exit, which may increase the efficiency of the oven by limiting the unintentional expulsion of the air. Additionally, it is contemplated that two or more oven lines may extend through a common oven. Each of the oven lines may be configured differently to accommodate the materials/components passing there through. For example, a first line may be used for footwear uppers and a second line may be used for footwear bottom units (e.g., soles) allowing for the co-curing/drying of the components for eventual combination. This layering concept may reduce operating space needed to cure the components and allow for a sharing of resources and/or an increase in efficiencies.

In an exemplary aspect, an energy efficient oven comprises a chamber that has an entry on a first side and an exit on an opposite second side with a top extending between the first side and the second side is provided. A longitudinal direction of the oven is defined as extending between the first side and the second side. This oven also includes a conveyance system that extends within the chamber from the first side to the second side. Further, the oven includes a circulation plate that extends between the conveyance system and the top of the chamber. The circulation plate is comprised of a first region proximate the chamber first side, a second region, and a third region proximate the chamber second side, the second region is between the first region and the third region. The circulation plate first region is comprised of a plurality of first region apertures; the circulation plate second region comprised of a plurality of second region apertures; and the circulation plate third region comprised of a plurality of third region apertures. A first distance extending in the longitudinal direction between longitudinally adjacent apertures of the plurality of first region apertures, a second distance extending in the longitudinal direction between longitudinally adjacent apertures of the plurality of second region apertures, and a third distance extending in the longitudinal direction between longitudinally adjacent apertures of the plurality of third region apertures. The second distance is less than the first distance and third distance.

In an additional exemplary aspect, an energy efficient oven comprises a chamber, a conveyance system, an infrared source, and a circulation plate. The circulation plate extends between the conveyance system and a top of the chamber. The circulation plate is comprised of a first region proximate the chamber first side, a second region, and a third region proximate the chamber second side. The second region between the first region and the third region. The first region is comprised of a plurality of first region apertures, the second region is comprised of a plurality of second region apertures, and the third region is comprised of a plurality of third region apertures. In this example there is a higher concentration of second region apertures than a concentration of first region apertures or concentration of second region apertures for a similar measured area (e.g., a square meter). In an alternative example, the second region has a greater number of apertures positioned between infrared sources than in the first or third regions.

Figure 9:
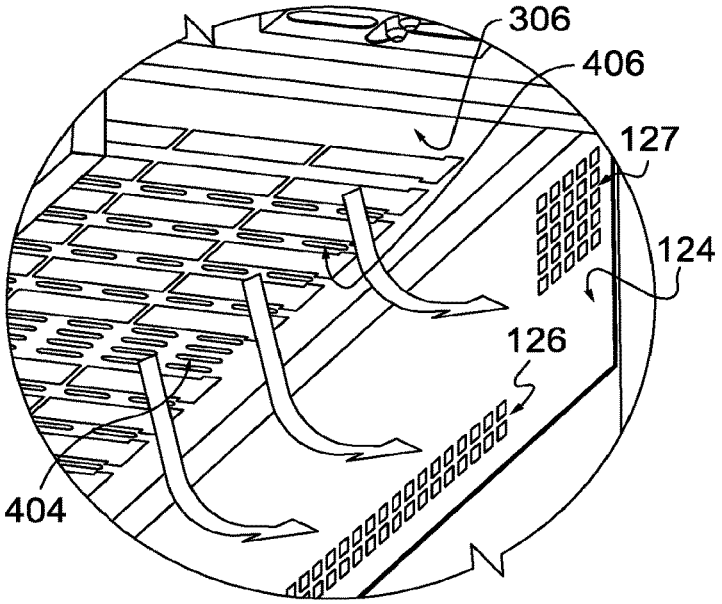
FIGS. 9 depicts an enlarged view of the second circulation plate in relation to side vents and end vents, in accordance with aspects hereof.
Figure 10:
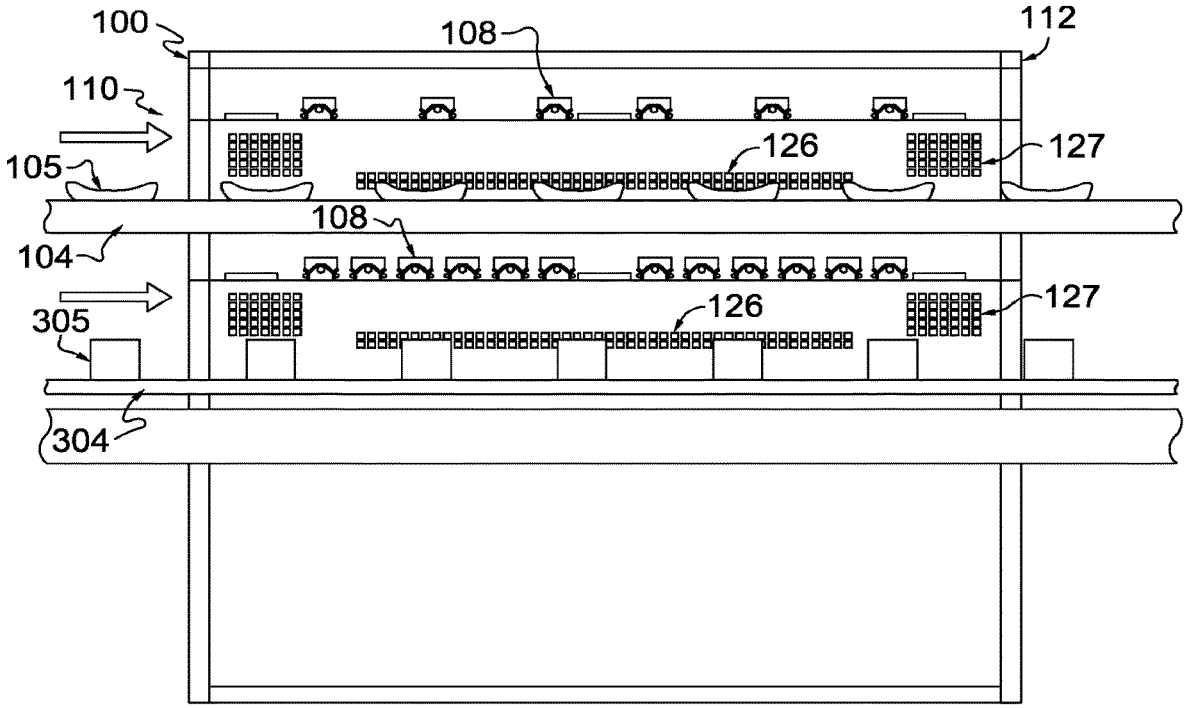
FIG. 10 illustrates a side cross sectional view of the energy efficient oven with exemplary components passing there through, in accordance with aspects hereof.

Referring to FIG. 1 illustrating an oven 100 in accordance with aspects hereof. As will be discussed hereinafter, the oven 100 is illustrated having two lines extending there through, but it is contemplated that an oven may have a single line or multiple discrete lines layered within the oven. Further, the conveyance system(s) have been omitted from FIGS. 1-9 for clarity purposes, but as depicted in FIG. 10, a conveyance system 104, 304 is contemplated in the various aspects provided herein. The conveyance system(s) may comprise a conveyor belt, chain system, or any other conveyance mechanism to move items to be cured, such as shoes or shoe components, through the oven 100.

The oven 100 may be comprised of a chamber 102, a first side 110, an opposite second side 112, a top 114, a side chamber 124, and one or more fans 128. Additional elements will be depicted and described in connection with subsequent figures. A side panel that exposes the side chamber 124 has been removed from FIG. 1 for illustrative purposes; however, it is contemplated that the side chamber 124 may be effective to transfer air from an internal volume of the oven 100 at a conveyor system to be expelled at a location above the conveyor system at a circulation plate through a plurality of zones having a plurality of apertures extending there through. Further, it is contemplated that a side chamber 124 may be positioned on both sides of the oven 100 as depicted in various Figures provided herein. Further, it is contemplated that a side chamber 124 may be comprised of multiple discrete volumes that isolate airflow between a first oven portion and a second oven portion (e.g., top and bottom, longitudinally first and longitudinally second). A longitudinal direction 116 extends between the first side 110 and the second side 112 that also parallels with a material flow direction through the oven 100. As will be discussed, the longitudinal direction is relevant, in some examples, to the positioning and characteristics of features associated with air circulation and/or infrared sources to enhance efficiencies of the oven 100. For example, airflow characteristics (e.g., direction, volume, velocity, aperture spacing/concentration) is adjusted near an entrance to the chamber proximate the first side 110 and/or near an exit to the chamber proximate the second side 112 relative to a middle region of the oven 100. The density, positioning, and relative spacing of infrared sources may also be adjusted in the longitudinal direction to increase oven efficiencies.

Figure 2:
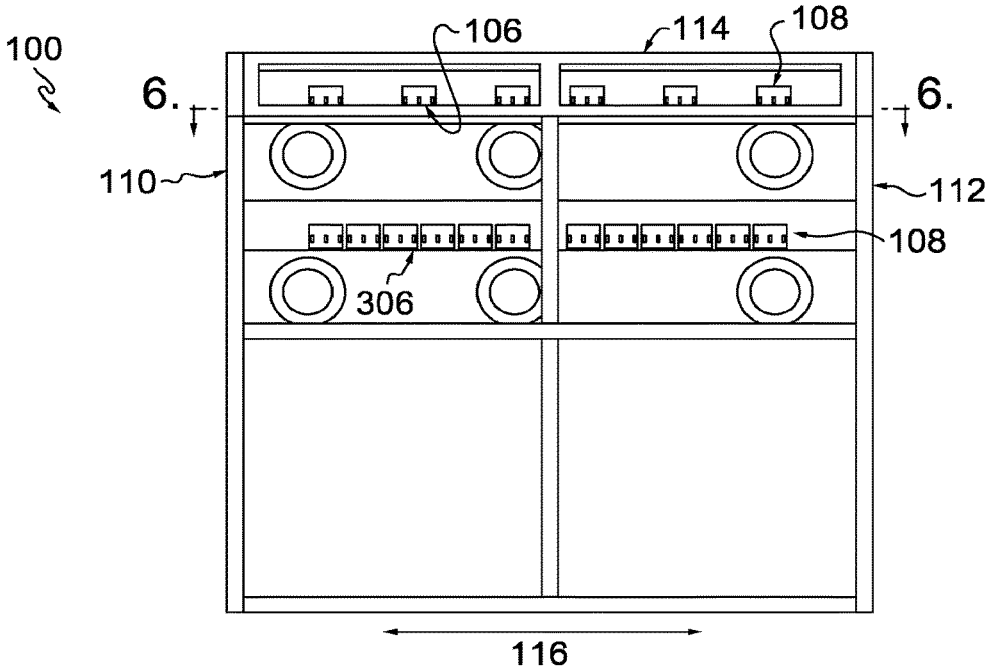

FIG. 2 illustrates a side view of the oven 100, in accordance with aspects hereof. The first side 110 and the second side 112 define the longitudinal direction 116 of the oven 100. FIG. 2 also depicts the side paneling of the oven 100 removed to illustrate infrared sources 108. The infrared sources 108 may emit primarily in the MIR region of the spectrum, although other emission spectra may be used for an oven in accordance with aspects hereof. A logical unit (not shown) may control the wattage of one or more of the infrared sources 108. Alternatively, rather than dynamically controlling the power output of one or more of the infrared sources 108, the power output of the first plurality of infrared sources 108 may be predetermined.

The infrared sources 108 may have various shapes and sizes and may be oriented in different configurations relative to one another and relative to longitudinal direction 116. In the example illustrated in FIG. 2, infrared sources 108 have a shape that provides a longitudinal axis and that longitudinal axis is oriented substantially perpendicular to the longitudinal direction 116. However, infrared sources used in accordance with aspects hereof may be oriented with a longitudinal axis parallel to the longitudinal direction 116 or at any other angle relative to the longitudinal direction 116. Individual infrared sources 108 may have other shapes than that depicted herein, such as circular, square, triangular, curved, etc. Different infrared sources in single or different pluralities of infrared sources may have different shapes. While the figures herein illustrates an example oven 100 in accordance with aspects hereof wherein individual infrared sources of a plurality of infrared sources are distributed in a direction substantially perpendicular to longitudinal direction 116, individual infrared sources may also/alternatively be distributed along a direction parallel (or in any other direction) to the longitudinal direction 116, and infrared sources need not be distributed in a regular, repeating, or uniform manner. Any number of infrared sources may be utilized in ovens in accordance with aspects. Spacing longitudinally along the oven 100 in accordance with aspects hereof may be at 5 to 40 centimeter intervals for infrared sources 108.

The precise type, wattage, and number of infrared sources 108 used for an oven in accordance with aspects hereof may vary based upon the type of operation to be performed and the materials of the item to be treated using an oven in accordance with aspects hereof. For example, the example oven 100 may use MIR infrared sources exclusively in order to facilitate the evaporation of water from a shoe or shoe part. Other types of infrared sources may be selected, however, particularly for performing other operations and/or for treating different types of items.

Figure 3:
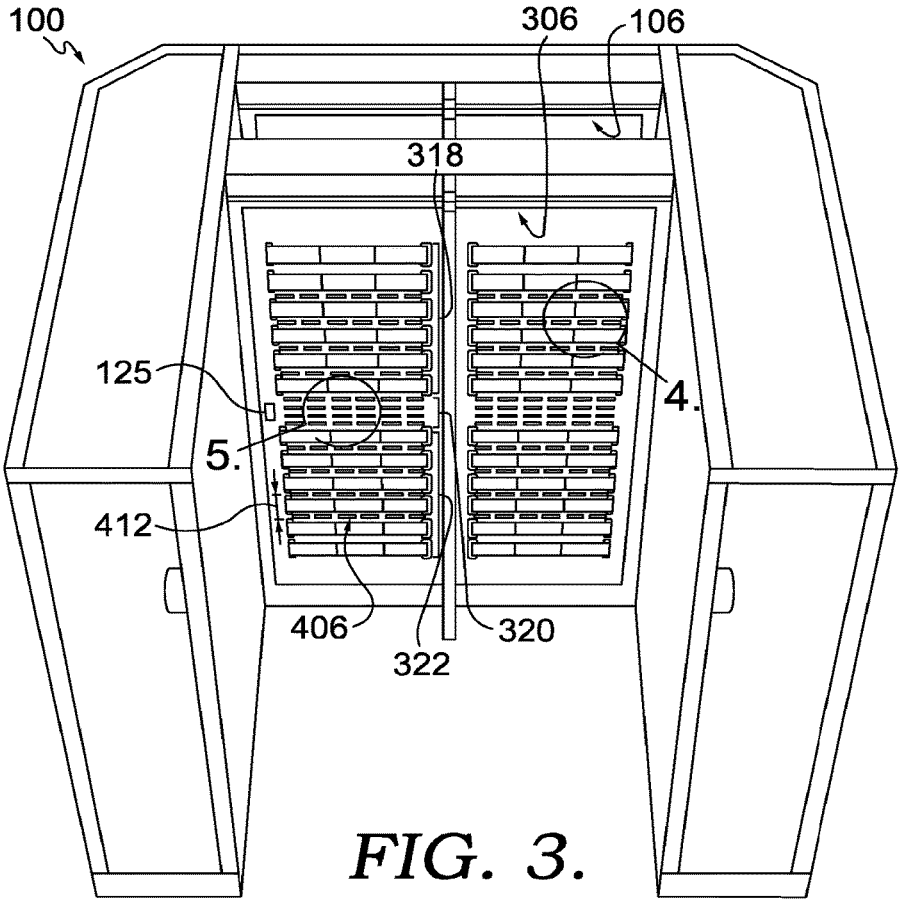
FIG. 3 illustrates a bottom-up perspective view the energy efficient oven in accordance with aspects hereof.

Conditions inside of the oven 100 may be measured or quantified using one or more sensors, such as a humidity and/or temperature sensor 125 of FIG. 3. While one exemplary sensor is illustrated herein, any number of sensors, from none to any number exceeding one, may also be used in accordance with aspects hereof. Sensors may measure properties such as temperature, humidity, air flow, etc., in any fashion. For example, sensors may comprise an infrared temperature meter that measures the temperature of a shoe part at a given location within the oven 100, while a second sensor may comprise a second infrared temperature meter that measures the temperature of a shoe part at a second location in the oven 100. Measurements obtained by the sensors may be used for monitoring and, if desired, adjusting the temperature and/or airflow in the oven 100 and/or quality control purposes. Further, different sensors may serve different or even multiple, purposes. As described further herein, other types of sensors, such as the humidity and/or temperature sensor 125, may be useful in determining conditions inside of the oven 100 that may be dynamically adjusted to obtain a beneficial cure quality for shoes or shoe parts moving through the oven 100. Even if an oven such as the example oven 100 are not dynamically controllable based upon the readings of sensors, the use of sensors may be beneficial for quality control purposes, for data gathering purposes to optimize curing conditions, or for other purposes.

Within oven 100 air flow may facilitate curing of shoes or shoe parts moving along one or more conveyor systems. As will be illustrated in the example of FIG. 9, air flow may move generally in the direction indicated by arrows which, in the present example, corresponds to a direction perpendicular to the longitudinal direction 116. As explained further herein, other air flow directions may be used in addition to or instead of the air flow illustrated in the example schematic of FIG. 9. Air flow may be attained by simply providing openings, apertures in a circulation plate in the oven 100, through the use of fans, through the use of vents, baffles, or other mechanisms or any other way in which air flow may be managed, manipulated, or controlled to attain desired curing properties and parameters.

For example, the top line includes a circulation plate 106 that is positioned between the top 114 and a conveyor system, such as the conveyance system 104 of FIG. 10. The circulation plate 106 may serve as a coupling member for one or more infrared sources 108 such that infrared energy passes through, or is emitted from, the circulation plate. For example, the circulation plate may include one or more opening through which infrared sources 108 pass allowing an emitting portion of the infrared sources 108 to be positioned in an effective location for exposing one or more components to infrared energy while positioning componentry of the infrared sources 108 above the circulation plate 106.

A secondary line extending through the oven 100 is comprised of a second circulation plate 306. Like the circulation plate 106, the second circulation plate 306 may support one or more infrared sources 108 and may contain one or more apertures extending there through for air flow management and control, in an exemplary aspect. As previously stated, however, the configuration of apertures and/or infrared sources may vary, as depicted in FIG. 2, between the circulation plate 106 and the second circulation plate 306. For example, based on the component type passing through each respective line, the infrared source and airflow characteristics may be varied.

Figure 6:
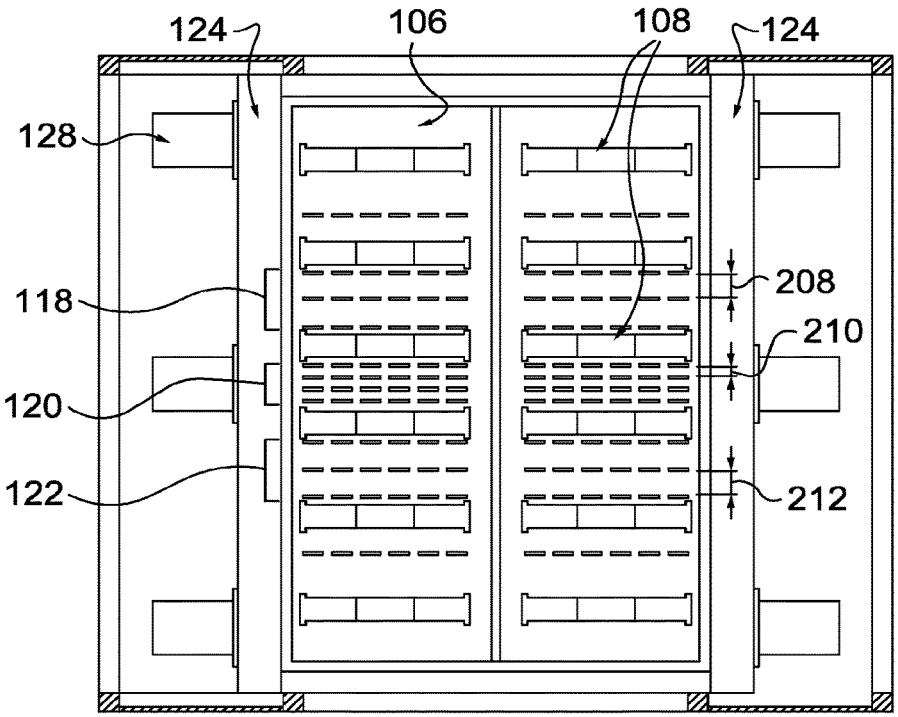
FIG. 6 illustrates a cross sectional view along line 6-6 of FIG. 2 of a circulation plate of the energy efficient oven, in accordance with aspects hereof.

FIG. 3 illustrates a bottom-up perspective of the oven 100, in accordance with aspects hereof. In this example, the second circulation plate 306 is depicted as the conveyance system has been removed for illustration purposes. The circulation plates of the oven 100 are comprised of multiple zones defined by a variation in aperture density and/or spacing. For example, at least three zones are depicted. A first zone 318, a second zone 320, and a third zone 322. As this is the second circulation plate 306, the zones may also be referred to as "secondary" first, second, and third zones for clarity relative to zones of the circulation plate 106 as illustrated in FIG. 6 hereinafter.

Figure 5:
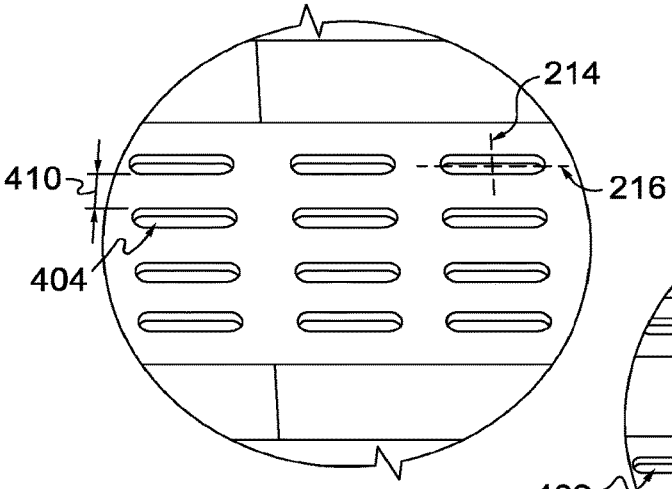
FIG. 5 illustrates an enlarged view of the circulation plate of FIG. 3 at a second zone, in accordance with aspects hereof.
Figure 4:
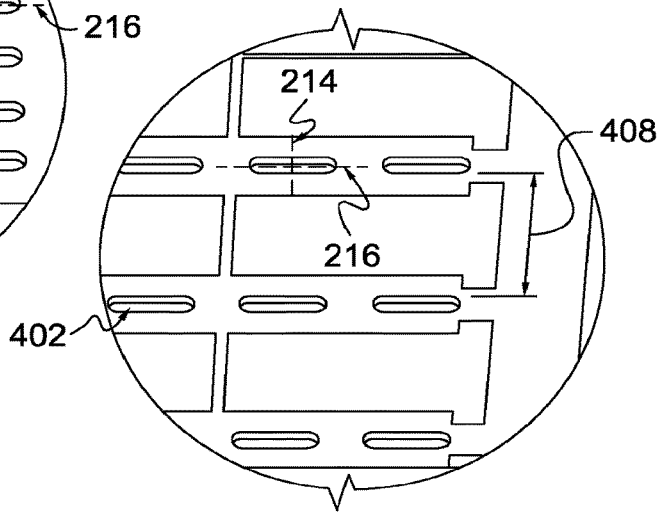
FIG. 4 illustrates an enlarged view of a circulation plate of FIG. 3 at a first zone, in accordance with aspects hereof.

The zones of a circulation plate may be defined as a transition in the longitudinal direction 116 of the aperture spacing and/or density. For example, FIG. 4 depicts an enlarged view of a portion from the first zone 318 and FIG. 5 depicts an enlarged view of a portion from the second zone 320, in accordance with aspects hereof. Each zone is comprised of a plurality of apertures. For example, on the second circulation plate 306, the first zone 318 is comprised of a first zone plurality of apertures 402 (as partially seen in FIG. 4), the second zone 320 is comprised of a second zone plurality of apertures 404 (as partially seen in FIG. 5), and the third zone is comprised of a third zone plurality of apertures 406 (as seen in FIG. 3).

An aperture extending through a circulation plate may have any shape. For example, slots, circular, oval, elliptical, rectilinear, and the like may be implemented. In the illustrated examples, efficiencies in airflow control may be achieved with an elliptical shape having a minor axis 214 parallel with the oven's longitudinal direction 116 and a major axis 216 that is perpendicular to the oven's longitudinal direction 116, as depicted in FIGS. 4 and 5.

Differences in distances between longitudinally adjacent apertures (i.e., apertures neighboring in the longitudinal direction) may be used to differentiate between zones. For example, the first zone 318 has a first distance 408 between longitudinally adjacent apertures, as shown in FIG. 4. The second zone 320 has a second distance 410 between longitudinally adjacent apertures, as shown in FIG. 5. The third zone 322 has a third distance 412 between longitudinally adjacent apertures, as shown in FIG. 3. In these examples, the first distance 408 and the third distance 412 may be the same or different. Further, it is contemplated that the second distance 410 is less (e.g., shorter) than the first distance 408 and/or the third distance 412. Stated differently, the second distance, which is distal from either of an entrance or exit to the oven 100, may have a greater concentration of apertures extending through a circulation plate at this distal location from entrances/exits to limit energy loss from an internal volume of the oven, in an exemplary aspect.

In another aspect, the second zone 320 has a higher concentration of apertures than the first zone 318 or the third zone 322. A concentration of apertures is measure based on a common area size, such as a square half meter. In this example, the second zone plurality of apertures 404 are similarly sized to the first zone plurality of apertures 402, but the second zone plurality of apertures are presented in a higher concentration. For example, one or more infrared sources are positioned between longitudinally adjacent apertures in the first zone 318 while there are longitudinally adjacent apertures in the second zone 320 that are not separated by infrared sources, in this exemplary aspect.

While the first zone 318 and the third zone 322 are depicted in a similar configuration, it is contemplated that any configuration may be used that is similar or different. Further, while a common aperture size and/or shape is depicted, it is contemplated that any combination of aperture sizes and shapes me be implemented.

FIG. 6 depicts a cut view of the oven 100 along the circulation plate 106 from line 6-6 of FIG. 2, in accordance with aspects hereof. Similar to the second circulation plate 306 of FIG. 3, the circulation plate 106 of FIG. 6 is comprised of a plurality of zones having different aperture configurations. For example, in a first zone 118 extending between infrared sources 108 longitudinally adjacent apertures have a first distance of 208, in a second zone 120 extending between infrared sources 108 longitudinally adjacent apertures have a second distance of 210, and in a third zone 122 longitudinally adjacent apertures have a third distance 212 between them. The first distance 208 may be greater than the second distance 210. The third distance 212 may be greater than the second distance 210. The first distance 208 may be the same as the third distance 212. The first distance 208 may be two to four time the second distance 210. The first distance 208 may be from 4 cm to 50 cm. The second distance 210 may be 1 cm to 30 cm. It is contemplated that any distance may be used. In general, however, aspects contemplate a higher concentration in a middle portion of the longitudinal direction 116 than at an entry or exit of the oven to increase efficiencies of the oven. Further or alternatively, it is contemplated that one or more orientations of apertures may be used to direct airflow away from an entrance or exit and towards a middle portion of the oven, in an exemplary aspect.

In contrast to FIG. 3, FIG. 6 depicts the circulation plate 106 having relatively consistent infrared source spacing in the longitudinal direction 116. In FIG. 3, a higher concentration of apertures is provided in the second zone 320, in part, through a spacing of the infrared sources 108 to accommodate the apertures 404 having the second distance 410 spacing. As such, it is contemplated that a circulation plate may be configured in any manner, such as through aperture spacing, positioning, and orientation, and/or through infrared source spacing, positioning, and orientation. The configuration of apertures and/or infrared sources may be altered at zone levels or across a whole circulation plate, in an exemplary aspect.

Figure 7:
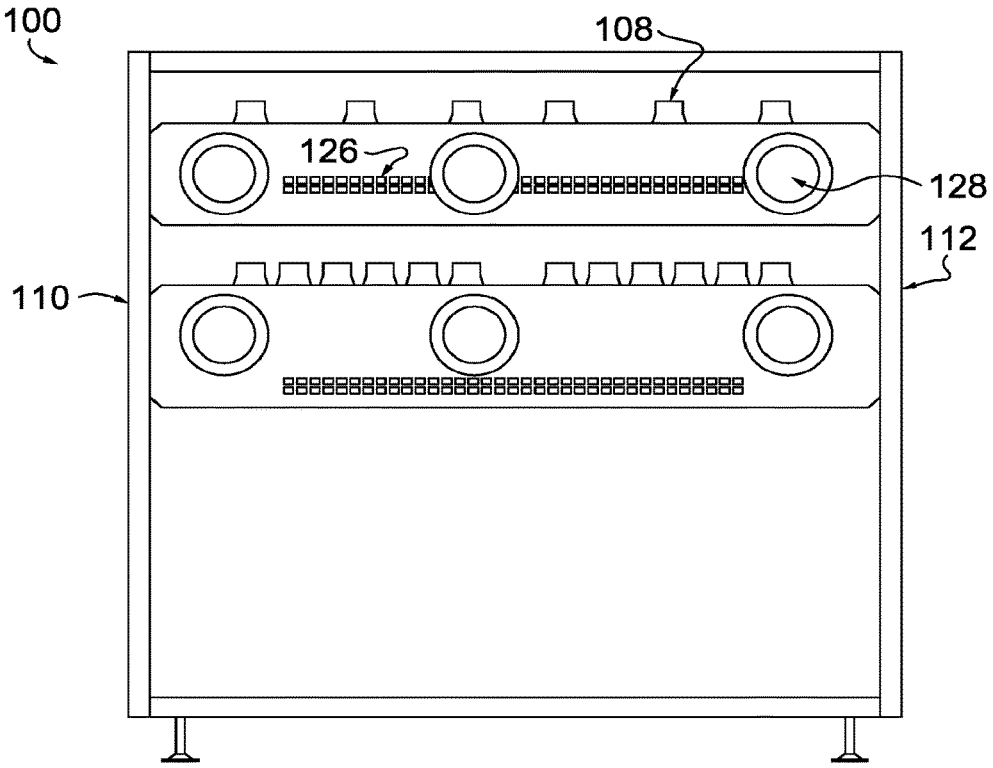
FIG. 7 illustrates a side profile of the energy efficient oven with side vents and end vents exposed, in accordance with aspects hereof.
Figure 8:
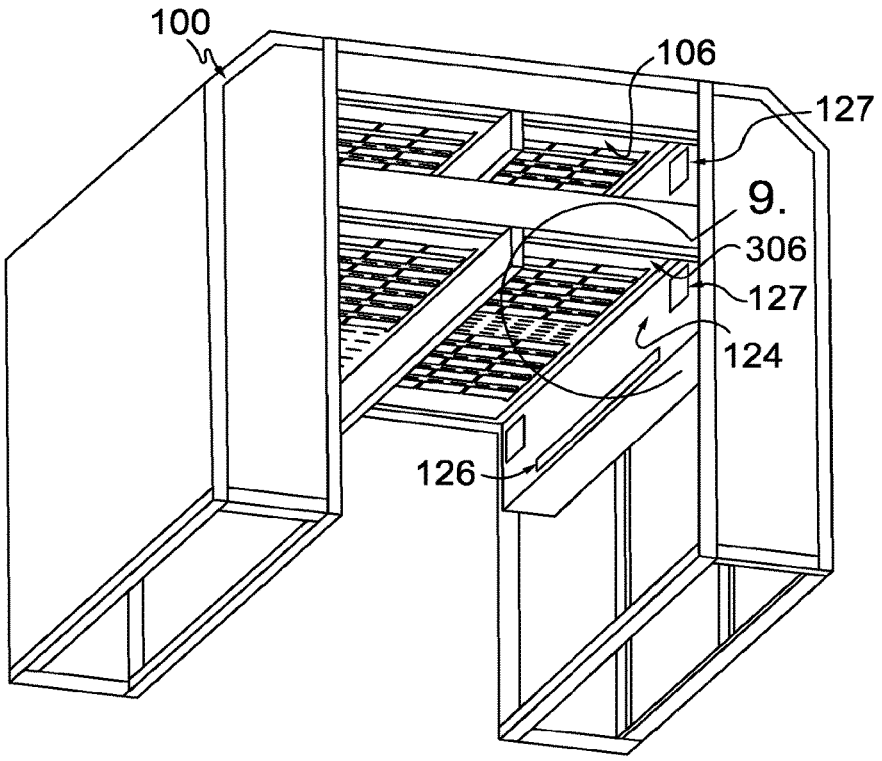
FIG. 8 illustrates a bottom-up perspective of the energy efficient oven with side vents and end vets exposed, in accordance with aspects hereof.

FIG. 7 illustrates a side view of the oven 100 with side vents 126, in accordance with aspects hereof. The side vents 126, as depicted in FIGS. 8 and 9, provide for a recirculation of air within the chamber in a manner that facilitates efficient energy usage through limited heat loss. For example, FIG. 8 depicts a perspective view of the oven 100 with the side vents 126 and end vents 127 depicted, in accordance with aspects hereof. FIG. 9 depicts an enlarged view of the second circulation plate 306 relative to the side vents 126 and end vents 127, in accordance with aspects hereof. Side vents 126 and end vents 127 may be referred to collectively as recirculation vents. For example, air is drawn through the side vents 126 and end vents 127 into the side chamber 124 by one or more fans 128. The side chamber 124 fluidly connects with the circulation plate, such as the second circulation plate 306 allowing for air to pass through the apertures of the circulation plate back towards the side vents 126 and/or end vents 127. This air movement forms a circulation cycle that aids in the efficiency of the oven. For example, as air moves past the infrared sources and the components being conveyed on the conveyance system, moisture and thermal energy are captured and drawn through the recirculation vents by the fans to be fluidly communicated to the circulation plate where the air is again passed through apertures by infrared sources and the components in a cycle. This circulation cycle aids in ensuring consistent conditions in the oven as the components are cured.

The end vents 127, as shown in FIG. 9, are positioned closer to the circulation plate to capture warm air prior to escaping at an entrance or an exit. This is in contrast to the side vents 126 that provide for air capture closer to a conveyance system transporting a component. As such, it is contemplated that a combination of side vents 126 and end vents 127 feeding air into a side chamber may produce an air flow that is effective to maintain an oven temperature while limiting energy loss at an entrance and/or exit. It is contemplated that any configuration of vents (e.g., side and/or end) may be used on a side panel forming the side chamber 124. For example, the vents may be of any size, shape, density, location, or configuration. Further, it is contemplated that any number, size, position, and/or configuration of fans may be used in accordance with aspects hereof to circulate air within the oven. The recirculation vents may be positioned on both longitudinal sides of the oven 100. Further, both sides of the oven that are parallel to the longitudinal direction 116 may have mirror-image configurations or different configurations of recirculating vents, in exemplary aspects. As depicted, each longitudinal side of the oven 100 may contain a side chamber that recirculates air to a portion of the circulation plate(s). For example, a side chamber on the right side of the oven may feed air to a right portion of a circulation plate. A side chamber on the left side of the oven may feed air to a left portion of the circulation plate. Further, right and left side chambers may work in concert to provide air to a whole circulation plate in an exemplary aspect.

FIG. 10 illustrates a side cross-sectional view of the oven 100 having two lines with components passing through the oven 100, in accordance with aspects hereof. The first line is comprised of the conveyance system 104 supporting a plurality of components 105 that enter through the first side 110 and pass through the oven to the second side 112 after being exposed to energy from a plurality of infrared sources 108. Air is circulated through the circulation plate and captured by one or more vents, such as side vents 126 and/or end vents 127. Within the same oven 100, a second line is comprised of the second conveyor system 304 supporting and conveying a plurality of components 305 that enter through the first side 110 and pass through the oven to the second side 112 after being exposed to energy from the a plurality of infrared sources 108. Air is circulated through the second circulation plate and captured by one or more vents, such as side vents 126 and/or end vents 127. It is contemplated that the first line and the second line may be isolated from each other allowing for different air conditions, humidity, and/or temperature to be used for each line. For example, it is contemplated that the side chamber 124 is configured to isolate, such as through a blocking wall that separates the side chamber, recirculated air of the first line from recirculated air of the second line. For example, the side chamber may have discrete volumes that inhibit the comingling of air from the first line with air from the second line. Alternatively, the conditions of the two lines may not be isolated and instead comingled to provide a greater volume of air to circulate and serve as a buffer from change, in an exemplary aspect.

Regardless, it is contemplated that elements of the first line (e.g., fan speed, infrared source, conveyor system speed, circulation plate configuration) may operate independently of the second line. Further, it is contemplated that any number of lines may be present in an exemplary oven. In yet an even further consideration, it is contemplate that the side chamber may have discrete volumes in a longitudinal direction as well. Therefore air from a portion of the oven proximate the entrance does not comingle with air from a portion of the oven proximate the exit. Further yet, it is contemplated that discrete volumes may exists in both the longitudinal direction and the vertical direction allowing for isolated circulated air between lines and longitudinal portions, in exemplary aspects. While specific examples of the side chamber 124 are depicted herein, it is contemplated that a chamber may be implemented to allow for the fluid connectivity of a line with a circulation plate in any configuration. Therefore, a side chamber may take on any configuration.

Aspects contemplated include various concepts, such as those captured in the following clauses.

Clause 1. An oven comprising: a chamber, the chamber having an entry on a first side and an exit on an opposite second side, a longitudinal direction of the oven defined as extending between the first side and the second side; a conveyance system, the conveyance system extending within the chamber from the first side to the second side; an infrared source; and a circulation plate, the circulation plate extending between the conveyance system and a top of the chamber, wherein the circulation plate is comprised of a first region proximate the chamber first side, a second region, and a third region proximate the chamber second side, the second region between the first region and the third region; and the first region comprised of a plurality of first region apertures, the second region comprised of a plurality of second region apertures, and the third region comprised of a plurality of third region apertures, wherein there is a higher concentration of second region apertures than a concentration of first region apertures or concentration of second region apertures.

Clause 2. The oven of clause 1 further comprising an infrared source, the infrared source positioned within the chamber between the conveyance system and the circulation plate.

Clause 3. The oven of clause 2, wherein the infrared source emits energy in peak wavelengths for emitted spectra of infrared energy in a range of 2 to 6 micrometers.

Clause 4. The oven of clause 1, wherein the plurality of second region apertures region have a non-circular profile through the air circulation plate.

Clause 5. The oven of clause 1, wherein an infrared source is positioned between the plurality of first region apertures and the plurality of second region apertures.

Clause 6. The oven of clause 1, wherein the first region aperture concentration is the same as the third region aperture concentration.

Clause 7. The oven of clause 1 further comprising a side chamber extending between the first side and the second side, the side chamber provides fluid connectivity from the chamber between a volume defined by the conveyance system and the circulation plate to a volume defined between the circulation plate and the top, such that air may be recirculated through the plurality of first region apertures, the plurality of second region apertures, and the plurality of third region apertures by way of the side chamber.

Clause 8. The oven of clause 1, wherein the plurality of second region apertures have a shorter distance in the longitudinal direction than in a perpendicular direction.

Clause 9. The oven of clause 1, wherein the plurality of second region apertures are elliptical with a minor axis in the longitudinal direction.

Clause 10. The oven of clause 1, wherein the plurality of first region apertures direct air away from the entrance and the plurality of third region apertures direct air away from the exit.

Clause 11. The oven of clause 1 further comprising a temperature sensor, the temperature sensor controlling a fan effective for passing air through at least the plurality of apertures of the first region, the plurality of apertures of the second region, or the plurality of apertures of the third region.

Clause 12. The oven of clause 1, wherein the first region is comprised of at least one infrared source effective to emit energy in peak wavelengths for emitted spectra of infrared energy in a range of 2 to 6 micrometers, wherein the second region is comprised of at least one infrared source effective to emit energy in peak wavelengths for emitted spectra of infrared energy in a range of 2 to 6 micrometers, and wherein the third region is comprised of at least one infrared source effective to emit energy in peak wavelengths for emitted spectra of infrared energy in a range of 2 to 6 micrometers.

Clause 13. The oven of clause 1, wherein the circulation plate extends in a plane parallel to the conveyance system.

Clause 14. The oven of clause 1, further comprising: a second conveyance system, the second conveyance system extending within the chamber from the first side to the second side; a second circulation plate, the second circulation plate extending between the second conveyance system and the conveyance system, wherein the second circulation plate is comprised of a secondary first region proximate the chamber first side, a secondary second region, and a secondary third region proximate the chamber second side, the secondary second region is between the secondary first region and the secondary third region; the second circulation plate secondary first region is comprised of a plurality of first region apertures, the second circulation plate secondary second region comprised of a plurality of second region apertures, and the second circulation plate secondary third region comprised of a plurality of third region apertures; and wherein there is a higher concentration of apertures in the secondary second region than a concentration of apertures in the secondary first region apertures or concentration of apertures in the secondary third region.

Clause 15. The oven of clause 14, wherein the secondary first region aperture concentration is the same as the secondary third region aperture concentration.

Clause 16. The oven of clause 14, wherein the circulation plate and the second circulation plate have different aperture configurations.

Clause 17. The oven of clause 14, wherein one or more infrared sources are coupled to the second circulation plate.

Clause 18. The oven of clause 14 further comprising one or more recirculation vents extending through a side wall, the sidewall extending in the longitudinal direction and in a plane perpendicular to the circulation plate.

Clause 19. The oven of clause 18, wherein the recirculation vents are comprised of both side vents and end vents.

While the invention is illustrated herein with specific examples, variations may be made within the scope of the present invention. For example, more than two pluralities of infrared sources may be used without departing from the scope of the present invention, while fewer than two pluralities may be used without departing from the scope of the present invention. The number of infrared sources of any given plurality and their relative spacing may be varied. Further, the positioning of any one infrared source or any plurality of infrared sources may be adjustable, either dynamically or in between oven operation cycles to permit a finer adjustment of the infrared radiation delivered to work pieces. For example, infrared sources may be moved closer or further from a conveyance mechanism and may be spaced more or less densely along a linear distance within an oven.

What is claimed is:

1. An oven comprising:

a chamber, the chamber having an entry on a first side and an exit on an opposite second side with a top extending between the first side and the second side, a longitudinal direction of the oven defined as extending between the first side and the second side;

a conveyance system, the conveyance system extending within the chamber from the first side to the second side;

a circulation plate, the circulation plate extending between the conveyance system and the top of the chamber, wherein the circulation plate is comprised of a first region proximate the chamber first side, a second region, and a third region proximate the chamber second side, the second region is between the first region and the third region;

the circulation plate first region is comprised of a plurality of first region apertures, the circulation plate second region comprised of a plurality of second region apertures, and the circulation plate third region comprised of a plurality of third region apertures;

a first distance extending in the longitudinal direction between longitudinally adjacent apertures of the plurality of first region apertures, a second distance extending in the longitudinal direction between longitudinally adjacent apertures of the plurality of second region apertures, and a third distance extending in the longitudinal direction between longitudinally adjacent apertures of the plurality of third region apertures, wherein the second distance is less than the first distance and third distance;

an infrared source, the infrared source positioned within the chamber between the conveyance system and the circulation plate a second conveyance system, the second conveyance system extending within the chamber from the first side to the second side;

a second circulation plate, the second circulation plate extending between the second conveyance system and the conveyance system, wherein the second circulation plate is comprised of a secondary first region proximate the chamber first side, a secondary second region, and a secondary third region proximate the chamber second side, the secondary second region is between the secondary first region and the secondary third region;

the second circulation plate secondary first region is comprised of a plurality of first region apertures, the second circulation plate secondary second region comprised of a plurality of second region apertures, and the second circulation plate secondary third region comprised of a plurality of third region apertures; and a secondary first distance extending in the longitudinal direction between longitudinally adjacent apertures of the secondary first region, a secondary second distance extending in the longitudinal direction between longitudinally adjacent apertures of the secondary second region, and a secondary third distance extending in the longitudinal direction between longitudinally adjacent apertures of the secondary third region, wherein the secondary second distance is less than the secondary first distance and secondary third distance.

2. The oven of claim 1, wherein the infrared source emits energy in peak wavelengths for emitted spectra of infrared energy in a range of 2 to 6 micrometers.

3. The oven of claim 1, wherein the plurality of second region apertures region have a non-circular profile through the air circulation plate.

4. The oven of claim 1, wherein an infrared source is positioned between the plurality of first region apertures and the plurality of second region apertures.

5. The oven of claim 1, wherein the first distance is the same as the third distance.

6. The oven of claim 1 further comprising a side chamber extending between the first side and the second side, the side chamber provides fluid connectivity from the chamber between a volume defined by the conveyance system and the circulation plate to a volume defined between the circulation plate and the top, such that air may be recirculated through the first region apertures, second region apertures, and third region apertures by way of the side chamber.

7. The oven of claim 1, wherein the plurality of apertures of the second region have a shorter distance in the longitudinal direction than in a perpendicular direction.

8. The oven of claim 1, wherein the second region of apertures are elliptical with a minor axis in the longitudinal direction.

9. The oven of claim 1, wherein the plurality of first region apertures direct air away from the entrance and the plurality of third region apertures direct air away from the exit.

10. The oven of claim 1 further comprising a humidity sensor, the humidity sensor controlling a fan effective for passing air through at least the plurality of apertures of the first region, the plurality of apertures of the second region, or the plurality of apertures of the third region.

11. The oven of claim 1, wherein the first region is comprised of at least one infrared source effective to emit energy in peak wavelengths for emitted spectra of infrared energy in a range of 2 to 6 micrometers, wherein the second region is comprised of at least one infrared source effective to emit energy in peak wavelengths for emitted spectra of infrared energy in a range of 2 to 6 micrometers, and wherein the first region is comprised of at least one infrared source effective to emit energy in peak wavelengths for emitted spectra of infrared energy in a range of 2 to 6 micrometers.

12. The oven of claim 1, wherein the circulation plate extends in a plane parallel to the conveyance system.

13. The oven of claim 1, wherein the first distance and the secondary first distance are different.

14. The oven of claim 1, wherein the circulation plate and the second circulation plate have different aperture configurations.

15. The oven of claim 1, wherein one or more infrared sources are coupled to the second circulation plate.

16. The oven of claim 1 further comprising one or more recirculation vents extending through a side wall, the sidewall extending in the longitudinal direction and in a plane perpendicular to the circulation plate.

17. The oven of claim 16, wherein the recirculation vents are comprised of both side vents and end vents.

18. An oven comprising:

a chamber, the chamber having an entry on a first side and an exit on an opposite second side, a longitudinal direction of the oven defined as extending between the first side and the second side;

a conveyance system, the conveyance system extending within the chamber from the first side to the second side;

an infrared source;

a circulation plate, the circulation plate extending between the conveyance system and a top of the chamber, wherein the circulation plate is comprises a first region proximate the chamber first side, a second region, and a third region proximate the chamber second side, the second region between the first region and the third region;

the first region comprised of a plurality of first region apertures, the second region comprised of a plurality of second region apertures, and the third region comprises a plurality of third region apertures, wherein there is a higher concentration of second region apertures than a concentration of first region apertures or concentration of third region apertures;

a second conveyance system, the second conveyance system extending within the chamber from the first side to the second side; and a second circulation plate, the second circulation plate extending between the second conveyance system and the conveyance system, wherein the second circulation plate is comprised of a secondary first region proximate the chamber first side, a secondary second region, and a secondary third region proximate the chamber second side, the secondary second region is between the secondary first region and the secondary third region.

* * * * *